US005402108A

United States Patent [19]

Tabin et al.

[11] Patent Number: 5,402,108

[45] Date of Patent: Mar. 28, 1995

[54] DRIVER ALERTING SYSTEM

[75] Inventors: Aaron S. Tabin, Long Grove; Gary P. Watts, Buffalo Grove, both of Ill.

[73] Assignee: Just Right, Inc., Long Grove, Ill.

[21] Appl. No.: 27,905

[22] Filed: Mar. 8, 1993

[51] Int. Cl.[6] ..... G08B 21/00

[52] U.S. Cl. ..... 340/575; 340/309.15; 340/326; 340/439; 340/576; 180/272

[58] Field of Search ..... 340/309.15, 309.2, 309.3, 340/326, 439, 575, 576; 180/272

[56] References Cited

U.S. PATENT DOCUMENTS

| | | | |
|---|---|---|---|
| 3,559,205 | 1/1971 | Colby | 340/575 |
| 3,611,344 | 10/1971 | Couper | 340/575 |
| 3,761,921 | 9/1973 | Adler et al. | 340/576 |
| 3,922,665 | 11/1975 | Curry et al. | 180/272 |
| 3,947,815 | 3/1976 | Muncheryan | 340/575 |
| 4,234,051 | 11/1980 | Morris, Jr. | 340/575 |
| 4,679,648 | 7/1987 | Johansen | 180/272 |
| 4,879,542 | 11/1989 | Elsey | 340/426 |
| 5,012,226 | 4/1991 | Love | 340/576 |

*Primary Examiner*—John K. Peng
*Assistant Examiner*—Edward Lefkowitz
*Attorney, Agent, or Firm*—Emrich & Dithmar

[57] ABSTRACT

A driver alerting device plugs into a vehicle cigarette lighter and, after actuation of a reset button, triggers a flashing red warning light after a random time period. If the driver does not actuate the reset button within a predetermined time after the light begins flashing, a horn will beep.

17 Claims, 1 Drawing Sheet

DRIVER ALERTING SYSTEM

BACKGROUND OF THE INVENTION

1. Field of the Invention

The present invention relates to devices for use in automotive vehicles to combat drowsiness and maintain alertness of occupants of the vehicle.

2. Description of the Prior Art

A significant cause of automotive vehicle accidents is impairment of the operator's alertness as a result of drowsiness, fatigue, mental preoccupation, substance abuse and the like. Heretofore, attempts have been made to address this problem by providing alarm devices which alert the operator and require conscious activity by the operator to deactivate the alarm signal. One such device is disclosed in U.S. Pat. No. 5,012,226 and provides a timer which generates two different sequential time periods, at least the first of which is adjustable. Upon activation of the device, it generates a first alarm signal at the end of the first time period and, if the operator does not actuate a switch before the expiration of the second time period, then generates a second alarm signal. Each time the switch is actuated, the device is reset and starts the first time period again. Both of the time periods are predetermined so that the operator knows when to expect the first alarm signal. Furthermore, the device is rather bulky.

SUMMARY OF THE INVENTION

It is a general object of the invention to provide an improved operator alerting system which avoids the disadvantages of prior systems while affording additional structural and operating advantages.

An important feature of the invention is the provision of an operator alerting system which is of compact, simple and economical construction.

Still another feature of the invention is the provision of an operator alerting system of the type set forth which provides alerting alarm signals at randomly variable times.

Yet another feature of the invention is the provision of an operator alerting system of the type set forth which can be powered from and mounted in the cigarette lighter receptacle of a vehicle.

These and other features of the invention are attained by providing an operator alerting system comprising: first timer means selectively actuatable for initiating a substantially randomly variable first time period unknown to the operator and for generating an output signal at the expiration of said first time period, first annunciator means coupled to said first timer means for producing a first alarm indication at the expiration of said first time period, second timer means coupled to said first timer means and responsive to said output signal for initiating a second time period, second annunciator means coupled to said second timer means for producing a second alarm indication at the expiration of said second time period, and reset means for actuating said first timer means and terminating said output signal.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figures 1, 2, 3:
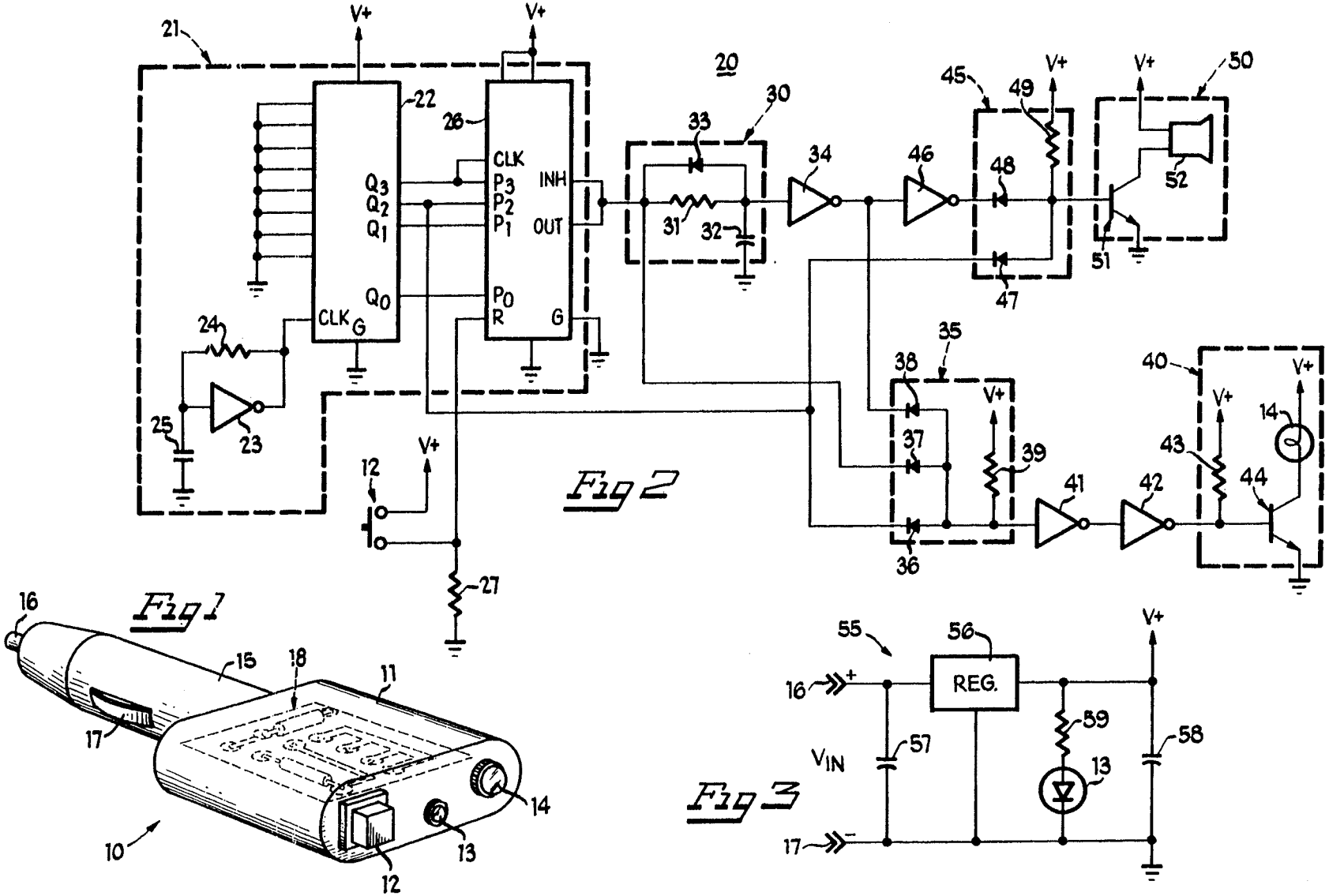
FIG. 1 is a perspective view of an operator alerting system constructed in accordance with and embodying the features of the present invention.
FIG. 2 is a schematic circuit diagram of the circuitry of the operator alerting system of FIG. 1.
FIG. 3 is a schematic circuit diagram of the power supply for the circuit of FIG. 2.

Referring to FIG. 1, there is illustrated an alerting device 10 constructed in accordance with the present invention. The device 10 includes a housing 11 on the front end of which is mounted a pushbutton switch 12, and two lamps 13 and 14, the lamp 13 preferably being a green light-emitting diode ("LED") and the lamp 14 preferably being a red incandescent lamp. The housing 11 is provided at the rear end thereof with an elongated, cylindrical plug 15 dimensioned to be plugged into the cigarette lighter receptacle of an associated vehicle, such as an automobile, truck, or the like, and being provided with an electrical contact 16 at the tip thereof and at least one contact 17 along the side thereof for connection across the battery of the vehicle. The contacts 16 and 17 are preferably resilient or spring loaded. Mounted in the housing 11 is a circuit board 18 on which is disposed the circuitry for the device 10.

More specifically, referring to FIG. 2, the circuit board 18 mounts a control circuit 20 which includes a random timer 21. The timer 21 includes an integrated circuit ("IC") counter 22, which has a clock terminal connected to the output of an inverter 23, across which is connected a resistor 24, the input of the inverter 23 being connected through a capacitor 25 to ground. The counter 22 may be a 4526 counter of the type sold by Motorola Corporation under the designation MC14526BCP, and it is configured with four output terminals $Q_0$–$Q_3$ which produce a parallel four-bit binary output signal. The random timer 21 also includes a counter 26, which may also be a 4526 IC counter having input terminals $P_0$–$P_3$, respectively connected to the output terminals of the counter 22. The counter 26 has a clock terminal which is connected to the $Q_3$ output terminal of the counter 22, and is also provided with a reset terminal which is connected through a resistor 27 to ground and through normally-open pushbutton switch 12 to a V+ supply voltage, which supply voltage is also provided to each of the counters 22 and 26. The counter 26 also has an output terminal and an inhibit terminal which are connected together.

The output terminal of the counter 26 is also connected to an analog RC timer 30. More specifically, the output terminal of the counter 26 is connected to ground through the series combination of a resistor 31 and a capacitor 32, a diode 33 also being connected across the resistor 31 with its cathode coupled to the output terminal of the counter 26. The junction between the resistor 31 and the capacitor 32 is connected to the input of an inverter 34, the output of which is connected to an AND gate 35. More specifically, the gate 35 includes parallel-connected diodes 36, 37 and 38 having their anodes connected together, with the cathode of the diode 36 being connected to the $Q_2$ output terminal of the counter 22, the cathode of the diode 37 being connected to the output terminal of the counter 26 and the cathode of the diode 38 being connected to the output of the inverter 34. The anodes of the diodes 36–38 are connected to the V+ supply through a resistor 39.

The output of the gate 35, at the anodes of the diodes 36–38, is connected to an annunciator 40 through series-connected inverters 41 and 42. More specifically, the output of the inverter 42 is connected to the V+ supply through a resistor 43, and is also connected to the base of a transistor 44, the emitter of which is grounded and the collector of which is connected through the lamp 14 to the V+ supply.

The output of the inverter 34 is also connected to an AND gate 45 through an inverter 46. More specifically, the gate 45 includes diodes 47 and 48, which have their anodes connected to the V+ supply through a resistor 49, with the cathode of the diode 47 being connected to the $Q_2$ output terminal of the counter 22 and the cathode of the diode 48 being connected to the output of the inverter 46.

The output of the gate 45 at the anode of the diodes 47 and 48 is connected to an annunciator 50 and, more particularly, to the base of a transistor 51, the emitter of which is grounded and the collector of which is connected to the V+ supply through a horn 52.

The V+ supply voltage for the control circuit 20 is provided by a power supply circuit 55, illustrated in FIG. 3. More specifically, the power supply circuit 55 has positive and negative input terminals which are, respectively, connected to the contacts 16 and 17 for receiving the input voltage $V_{IN}$ from the vehicle battery, which is typically 12 VDC. An IC voltage regulator circuit 56 is connected to the input terminals of the power supply circuit 55 and produces at its output a regulated V+ supply voltage which, in the case of a 12-volt battery, is regulated to a stable +12 VDC. It will be appreciated that the power supply circuit 55 requires that the associated vehicle must have a negative ground type electrical system. Capacitors 57 and 58 are, respectively, connected across the input and the output of the regulator 56. Also connected across the output of the regulator 56 is the series connection of a resistor 59 and the LED 13. The capacitors 57 and 58 provide filtering and stability for the regulator 56. The resistor 59 limits current through the LED 13. The regulator 56 may be a 78L12, such as that sold by National Semiconductor under the designation LM78L12ACZ. The inverters 23, 34, 41, 42 and 46 may be part of a hex inverter, such as that sold by Motorola Corporation under the designation MC14584BCP, and which is provided with the V+ supply voltage in a known manner through supply terminals (not shown).

In operation, when the operator of a vehicle begins to feel drowsy, he plugs the alerting device 10 into the cigarette lighter receptacle or other electrical accessory socket of the vehicle. The green LED 13 will immediately be illuminated to indicate that power is on. As soon as the V+ supply voltage is provided to the random timer 21, the counter 22 immediately begins repeatedly cycling through a decremented count sequence from 15 through zero. The inverter 23, the resistor 24 and the capacitor 25 comprise an oscillator circuit for the counter 22 which controls the rate at which it counts. Thus, with each pulse at its clock input, the counter 22 decrements one count until it reaches zero and then it goes back to 15 and starts over again, producing a parallel binary digital representation of each count in the sequence at the output terminals $Q_0$–$Q_3$.

The counter 26 is inactive until it receives a reset signal. In order to activate the device 10, the operator presses the pushbutton switch 12, applying a reset signal to the counter 26, which causes it to load at its input terminals $P_{0-P3}$ whatever count number then appears at the output of the counter 22. The counter 26 then immediately begins decrementing from that count to zero at a rate determined by the signal appearing at its clock input terminal. In the illustrated embodiment, this clock input terminal is connected to the $Q_3$ output terminal of the counter 22, so that the counter 26 counts at a rate 1/16 that of the counter 22. For example, if, when the reset switch 12 is actuated, the counter 22 were at a count of 10, the counter 26 would start decrementing from 10 and would decrement one count every 16 counts of the counter 22, i.e., each time the counter 22 rolled over to 15.

The counter 26 continues decrementing until it reaches zero, at which point it produces a high output signal at its output terminal, which is applied to its inhibit terminal to prevent any further counting. The output signal from the counter 26 is also applied through the gate 35 to cause the lamp 14 to start flashing. More specifically, the inputs to the gate 35 at the diodes 37 and 38 are both now high, allowing the $Q_2$ output from the counter 22 to pass the gate 35. Thus, as long as the $Q_2$ output is high, i.e., from counts 15 through 12 and 7 through 4 of the counter 22, the output of the gate 35 will be high, turning on the transistor 44 to illuminate the lamp 14, and when the $Q_2$ output is low (from counts 11 through 8 and 3 through zero) the lamp 14 will be turned off. Accordingly, the lamp 14 will flash at a rate $\frac{1}{8}$ the counting rate of the counter 22.

The output signal from the counter 26 is also applied to the timer 30, charging the capacitor 32 through the resistor 31. After a predetermined time period, determined by the time constant of the RC circuit, the capacitor 32 will charge to the threshold level of the inverter 34, causing its output to go low, thereby closing the gate 35 and inhibiting it from further flashing.

The low at the input of the inverter 46 causes its output to go high, enabling the AND gate 45 to pass the $Q_2$ output signal from the counter 22 to the annunciator 50. Thus, when the $Q_2$ output is high, the transistor 51 is turned on to sound the horn 52. Accordingly, the horn 52 will beep on and off at $\frac{1}{8}$ the counting rate of the counter 22. The horn 52 will continue beeping until the device 10 is unplugged from the cigarette lighter or until the reset switch 12 is closed. When the reset switch 12 is closed, the counter 26 is reset, causing its output to go low and allowing the capacitor 32 to discharge, thereby turning off the annunciator 50. The counter 26 starts decrementing again from whatever the new count is that was just loaded in from the counter 22, to begin the cycle all over again.

It will be appreciated that, in order to prevent the horn 52 from sounding, the operator must reset the counter 26 before the timer 30 times out. He will be signalled that this reset is necessary, when the lamp 14 begins flashing at the timeout of the counter 26, after which he will have the predetermined charging time of the capacitor 32 (e.g., five seconds) to reset the counter 26 before the horn 52 starts to sound. The time period counted by the counter 26 each time it is reset is random or pseudo-random, since it is dependent entirely upon the count loaded in from the counter 22 at reset, which could be anywhere from zero to 15 and is unknown to the operator. In this regard, the counter 22 preferably receives a number of clock pulses per second and may, for example, count at a rate between 5 and 20 Hz. It will be appreciated that the operator need not wait until the lamp 14 starts flashing, but can press the reset switch 12 at any time, thereby immediately restarting the count sequence of the counter 26.

From the foregoing, it has been seen that there has been provided an improved operator alerting system which is of simple, compact and economical construction and provides effective alerting of an operator at randomly spaced intervals.

We claim:

1. An operator alerting system comprising: first timer means selectively actuatable for initiating a randomly variable first time period unknown to the operator and for generating an output signal at the expiration of said first time period, first annunciator means coupled to said first timer means and including means for producing a first intermittent alarm indication at the expiration of said first time period, second timer means coupled to said first timer means and responsive to said output signal for initiating a second time period, second annunciator means coupled to said second timer means and including means for producing a second intermittent alarm indication at the expiration of said second time period, said first and second intermittent alarm indications having a rate of intermittency, said first timer means including means coupled to said first and second annunciator means for controlling the rate of intermittency of said first and second intermittent alarm indications, and reset means for actuating said first timer means and simultaneously terminating said output signal.

2. The system of claim 1, wherein said second timer means includes means for predetermining said second time period.

3. The system of claim 1, wherein said first annunciator means includes means responsive to said output signal for initiating said first alarm indication.

4. The system of claim 1, wherein said first annunciator means includes means for producing an intermittent visible first alarm indication.

5. The system of claim 4, wherein said second annunciator means includes means for producing an intermittent audible second alarm indication.

6. The system of claim 1, and further comprising DC power supply means adapted to be coupled to a battery of an automotive vehicle.

7. The system of claim 6, wherein said power supply means includes means engageable with a vehicle's cigarette lighter.

8. An operator alerting system comprising: a continuously operating first counter for repeatedly counting through a predetermined count sequence, a second counter coupled to said first counter and selectively actuatable for counting a first randomly variable time period unknown to the operator and determined by the count of said first counter when said second counter is actuated, said second counter generating an output signal at the expiration of said first time period, first annunciator means coupled to said second counter and including means for producing a first intermittent alarm indication at the expiration of said first time period, timer means coupled to said second counter and responsive to said output signal for beginning a second time period, second annunciator means coupled to said timer means and including means for producing a second intermittent alarm indication at the expiration of said second time period, said first and second intermittent alarm indications having a rate of intermittency, said first counter including means coupled to said first and second annunciator means for controlling the rate of intermittency of said first and second intermittent alarm indications, and reset means for simultaneously actuating said second counter and terminating said output signal.

9. The system of claim 8, wherein said second counter includes means for counting a second count sequence which begins with the count of said first counter when said second counter is actuated.

10. The system of claim 9, wherein said second counter includes means decrementing the count at a rate proportional to the counting rate of said first counter.

11. The system of claim 8, wherein said second counter includes inhibit means responsive to said output signal for terminating the counting of said second counter.

12. The system of claim 8, wherein said timer means includes analog timing means.

13. The system of claim 8, wherein said timer means includes means for predetermining said second time period.

14. The system of claim 8, wherein each of said first and second annunciator means includes means for producing an intermittent alarm indication.

15. The system of claim 14, wherein said first counter includes means coupled to said first and second annunciator means and producing a pulsating signal to control the rate of intermittency of said alarm indications.

16. The system of claim 15, wherein said first annunciator means includes means for producing a visible alarm indication and said second annunciator means includes means for producing an audible alarm indication.

17. The system of claim 15, wherein each of said first and second annunciator means includes gate means for controlling the passage of said pulsating signal.

* * * * *